United States Patent [19]

Sundberg et al.

[11] Patent Number: 4,500,268

[45] Date of Patent: Feb. 19, 1985

[54] ROTARY PUMP HAVING BRAKE MEANS WITH THERMAL FUSE

[75] Inventors: Jack G. Sundberg, Meriden; John P. Schaffner, South Windsor; Daniel J. Conlon, Hartford, all of Conn.

[73] Assignee: Chandler Evans Inc, West Hartford, Conn.

[21] Appl. No.: 430,828

[22] Filed: Sep. 30, 1982

[51] Int. Cl.[3] ..... F04C 2/18; F04C 15/00; B60T 13/04; F04B 49/02

[52] U.S. Cl. ..... 418/1; 418/69; 418/135; 418/181; 418/206; 188/151 A; 188/166; 417/214

[58] Field of Search ..... 418/69, 135, 181, 205, 418/206, 270, 1; 417/214; 415/9, 123; 188/151 A, 166; 308/1 A

[56] References Cited

U.S. PATENT DOCUMENTS

| | | | |
|---|---|---|---|
| 3,008,426 | 11/1961 | Edwards et al. | 418/69 |
| 3,111,904 | 11/1963 | Burns | 415/123 |
| 4,183,589 | 1/1980 | Heenan | 308/1 A |

*Primary Examiner*—John J. Vrablik

*Attorney, Agent, or Firm*—Redford W. Luther; Richard A. Dornon

[57] ABSTRACT

A backup fuel pump (16) has a thermal fuse (40) positioned in a bearing. The fuse is adapted to melt at a predetermined temperature during dry running of the pump. Melting of the fuse causes a spring urged braking member (42) to screw into a shaft journal (26) and terminate operation of the pump.

8 Claims, 2 Drawing Figures

ROTARY PUMP HAVING BRAKE MEANS WITH THERMAL FUSE

TECHNICAL FIELD

This invention relates to aircraft fuel pumps.

BACKGROUND ART

It has been proposed to incorporate a redundant pumping system in a fuel control for a gas turbine engine to provide for fuel delivery in the event of failure of the main fuel pump. Such a proposal has envisioned the incorporation of a backup pump mounted in a fuel tank and driven by a hydraulic motor. Obviously, a backup pump operating in the aforedescribed environment must never be allowed to run dry because excessive heat generation and a possible explosion could be occasioned.

DISCLOSURE OF THE INVENTION

In accordance with the invention, a thermal fuse is employed to terminate operation of a fuel pump when the temperature exceeds a predetermined limit.

A safety system of the invention has a braking member adapted to be displaced when the thermal fuse melts so as to engage and stop rotation of a selected component of the pump. The thermal fuse may be positioned in the pump at a location where heat generation is best sensed, as for example in a bearing. Upon melting of the fuse, the braking member may engage a rotating component of the pump, such as, for example, by the engagement of threads on the braking member and the rotating component.

Accordingly, it is a primary object of the invention to provide a pump with a means for stopping pump operation when excessive heat is generated.

This and other objects and advantages of the invention will become more readily apparent from the following detailed description when taken in conjunction with the accompanying drawings, in which:

BEST MODE OF CARRYING OUT THE INVENTION

Figure 1:
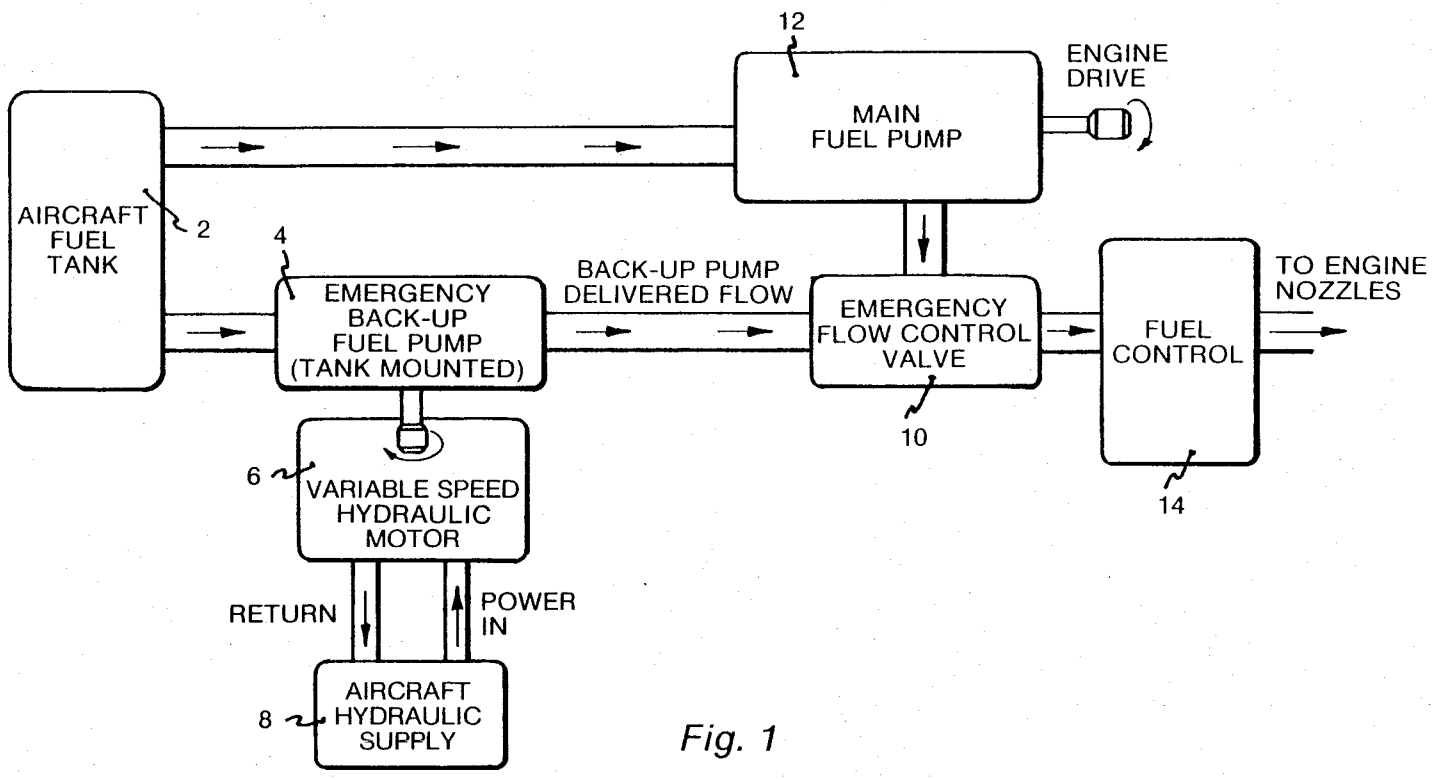
FIG. 1 is a block diagram showing a fuel control system adapted to incorporate a pump of the invention.

Referring to FIG. 1, there is shown a fuel control system embodying a pump of the invention. An aircraft fuel tank 2 has an emergency backup fuel pump 4 mounted therein. The pump 4 is driven by a variable speed hydraulic motor 6 connected to a source of hydraulic supply 8. Backup flow from the backup pump 4 is delivered to an emergency flow control valve 10 which also receives the output flow of the main fuel pump 12. Fuel flow from the emergency flow control valve, from either the main pump 12 or the backup pump 4 proceeds, to a fuel control 14 which incorporates a suitable metering valve across which the pressure differential is maintained at a constant value.

During normal system operation, the backup pump 4 will be running so as to thereby supply fuel pressure to the emergency flow control valve 10. The emergency flow control valve 10 will be in a shutoff condition and will not interfere with or in any way control flow from the main fuel pump 12. In the shutoff condition, the hydraulic motor 6 and the backup pump 4 will be in a stalled condition operating at safe pressure levels adequate to satisfy emergency transient conditions. The stalled motor 6 and pump 4 operate at a low speed sufficient to compensate for internal slippage flows within the pump 4 and the motor 6.

In the event of a failure of the main fuel pump 12, the emergency flow control valve senses such a failure and immediately directs fuel from the backup pump 4 to the fuel control 14. A differential pressure sensor within the flow control valve 10 senses the differential pressure across the metering valve and maintains it at a constant level by throttling the flow from the backup pump.

Figure 2:
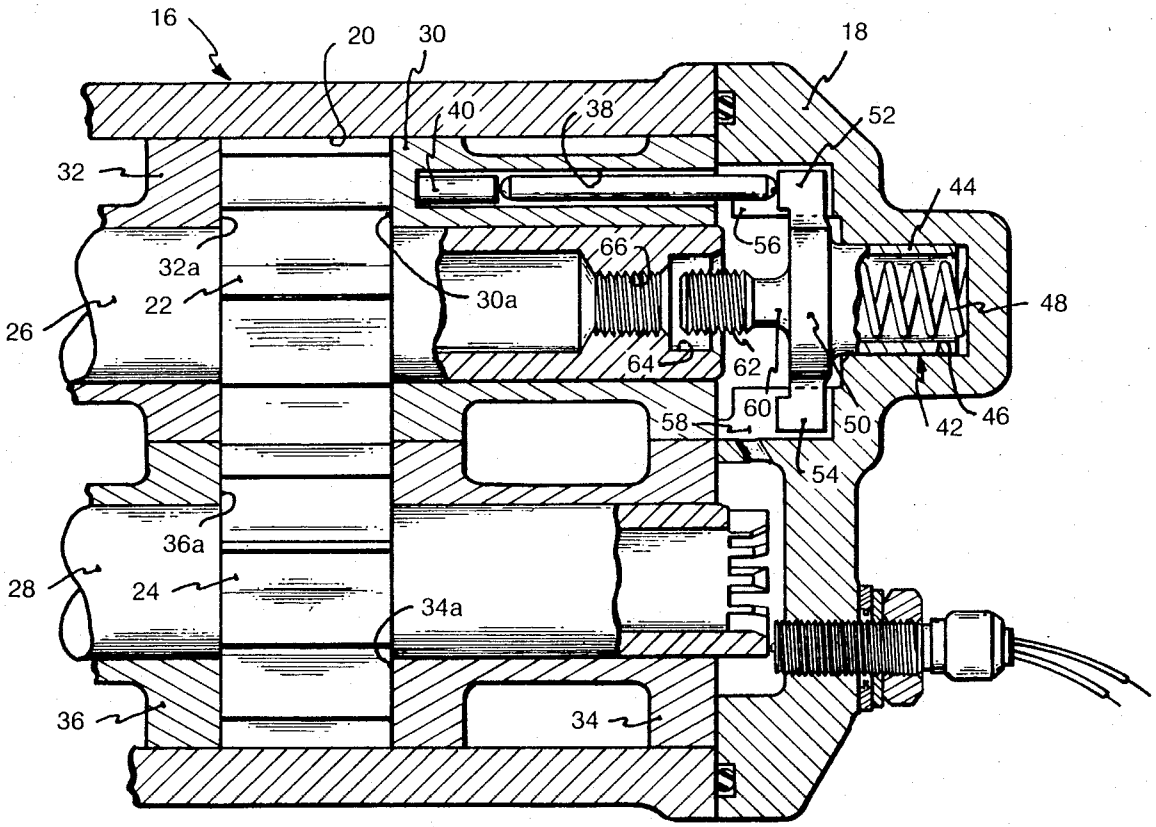
FIG. 2 is a fragmentary sectional view of a gear pump incorporating an embodiment of the invention.

Turning to FIG. 2, there is shown an embodiment of the invention incorporated in a gear pump 16 adapted for use as an emergency backup fuel pump. The gear pump 16 comprises a pump housing 18 having a pumping cavity 20. Within the pumping cavity 20 are mounted the usual pair of meshing gears 22 and 24. The gears 22 and 24, each of which are carried by shaft journals 26 and 28, are mounted for rotation within the interior portions of bearings 30, 32, 34 and 36. The bearings 30 and 34 have their faces **30*a* and 34*a* in respective wiping engagement with the right side faces of the gears 22 and 24. Similarly, the faces 32*a* and 36*a* of the bearings 32 and 36 are in respective wiping engagement with the left side faces of the gears 22 and 24**. The faces of the gears and the faces of the bearings are urged into firm engagement by the usual spring and pressure generated forces.

When the pump 16 runs dry, the pump temperature will begin to rise. Such a temperature increase can be most effectively sensed at the inboard portion of a bearing adjacent to the bearing face and the inner periphery thereof. To this end, bearing 30 is provided with a bore 38 extending parallel to the shaft journal 26 from the right face thereof to a base adjacent to the bearing face **30*a*. A commercially available thermal fuse 40, made of an alloy which melts at a predetermined temperature, is positioned at the base of the bore 38. Hence, when the inboard portion of the bearing 30 attains a sufficient temperature, the thermal fuse 40 will melt. The melting of fuse 40** will beget a stoppage of gear rotation, as is hereinafter described.

A braking member, generally indicated at 42, is adapted to engage the shaft journal 26 and terminate the rotation thereof when the thermal fuse 40 melts, thereby stopping the pump 16. The braking member 42 has a hollow cylindrical portion 44 mounted for axial sliding movement within a cavity 46 in the housing 18. A compression spring 48, disposed within the cylindrical portion 44, urges the braking member 42 leftwardly toward the shaft journal 26. The braking member 42 has a flange in the middle portion thereof 50 which carries a pair of diametrically opposed tabs 52 and 54 which are received with respective slots 56 and 58 in the housing 18. The tabs may move axially within the slots but cannot move radially, whereby rotation of the braking member 42 is restrained while axial movement thereof is permitted. The braking member 42 has an inwardly projecting stem 60 having a threaded section 62.

The threaded section 62 of the braking member 42 is received with a cavity 64 in the right end of the shaft journal 26 and confronts a threaded bore 66 which opens into the cavity 64. The threads of section 62 of the braking member 42 are sized to mate with the interior threads of the bore 66 whereby leftward axial movement of the braking member 42 causes the stem 60 to be screwed into the bore 66 during rotation of the shaft journal 26.

During normal operation of the pump 16, the braking member 42 is prevented from moving leftwardly by a pin 68 positioned in the bore 38 with its ends in respective compressive engagement with the thermal fuse 40 and the tab 52. However, during dry running, a melting of the fuse will permit the braking member to displace the pin to the left, thereby allowing the threaded section 62 to screw into the bore 66. When the tabs 52 and 54 engage the right face of the bearing 30, the threaded engagement between the section 62 and the bore 66 will result in a stoppage of the pump 16 and a consequential stoppage of the hydraulic motor 6.

Obviously many modifications and variations are possible in the light of the above teachings without departing from the scope or spirit of the invention as defined in the appended claims. For example, the invention could be utilized in a vane pump or another appropriate pump having a rotating pumping member.

We claim:

1. A method of preventing prolonged dry running of a pump having a shaft journal mounted for rotation in the pump, a rotating pumping member carried by the shaft journal for rotation therewith and a bearing positioned in the pump for rotatably mounting the shaft journal, which method comprises the steps of:

placing a thermal fuse in the bearing; and placing a braking member in the pump adjacent an end of the shaft journal, the braking member being adapted to engage and stop rotation of the shaft journal upon melting of the thermal fuse.

2. The method of claim 1, further comprising the steps of:

placing a threaded section on the braking member before placing it in the pump; and providing a threaded bore in the said end of the shaft journal.

3. A safety system for a pump including a shaft journal mounted for rotation in the pump, a rotating pumping member carried by the shaft journal for rotation therewith and a bearing positioned in the pump for rotatably mounting the shaft journal, which system comprises:

a thermal fuse adapted to melt at a predetermined temperature mounted in the bearing;

a braking member mounted in the pump adjacent an end of the shaft journal for moving into engagement with and stopping rotation of the shaft journal upon melting of the thermal fuse;

means to urge the braking member toward the shaft journal; and means engaging the braking member for preventing the braking member from moving into engagement with the shaft journal until melting of the fuse.

4. The system of claim 3, wherein the braking member comprises:

a stem having a threaded section; and wherein the shaft journal comprises:

a threaded bore in the said end thereof sized to have the threaded section screwed therein when the threaded section is moved into engagement therewith and the shaft journal is rotating.

5. A safety system for a pump including a pair of meshing gears, a pair of shaft journals mounted for rotation in the pump, the gears being respectively carried by the shaft journals and at least a pair of bearings positioned in the pump for respectively rotatably mounting the shaft journals, which system comprises:

a thermal fuse adapted to melt at a predetermined temperature mounted in one of the bearings;

a braking member mounted in the pump adjacent an end of a selected shaft journal for moving into engagement with and stopping rotation of the selected shaft journal upon melting of the thermal fuse;

means to urge the braking member toward the selected shaft journal; and means engaging the braking member for preventing the braking member from moving into engagement with the selected shaft journal until melting of the fuse.

6. The system of claim 5, wherein the braking member comprises:

a stem having a threaded section; and wherein the selected shaft journal comprises:

a threaded bore in the said end thereof sized to have the threaded section screwed therein when the threaded section is moved into engagement therewith and the selected shaft journal is rotating.

7. In an improved gear pump of the type having a housing, a pair of meshing gears in the housing, a pair of shaft journals in the housing, the gears being respectively carried by the shaft journals, at least two bearings mounted in the housing, the shaft journals being respectively mounted for rotation in the bearings, the improvement comprising:

a braking member mounted in the housing adjacent to a selected one of the shaft journals for axial movement into engagement with the selected shaft journal;

a thermal fuse positioned in the bearing in which the selected shaft journal is mounted;

means to engage the thermal fuse and the braking member for preventing axial movement of the braking member until the thermal fuse melts and permitting axial movement thereafter;

means urging axial movement of the braking member into engagement with the selected shaft journal; and means to establish threaded engagement between the braking member and the selected journal upon axial movement of the braking member for stopping rotation of the selected shaft journal.

8. The improvement of claim 7, wherein the threaded engagement establishing means comprises:

a threaded section on the braking member; and a threaded bore in the shaft journal in which the threaded section is adapted to be screwed.

* * * * *